US011406874B1

(12) United States Patent
Stewart

(10) Patent No.: US 11,406,874 B1
(45) Date of Patent: Aug. 9, 2022

(54) EXERCISE DEVICE

(71) Applicant: Roger K. Stewart, Windermere, FL (US)

(72) Inventor: Roger K. Stewart, Windermere, FL (US)

( * ) Notice: Subject to any disclaimer, the term of this patent is extended or adjusted under 35 U.S.C. 154(b) by 3 days.

(21) Appl. No.: 16/809,840

(22) Filed: Mar. 5, 2020

(51) Int. Cl.
*A63B 26/00* (2006.01)

(52) U.S. Cl.
CPC ..... *A63B 26/00* (2013.01); *A63B 2210/50* (2013.01)

(58) Field of Classification Search
CPC ..... A63B 2210/50; A63B 23/0458; A63B 23/0205–0227; A63B 2023/006; A63B 21/4037–4039; A63H 33/04–14
See application file for complete search history.

(56) References Cited

U.S. PATENT DOCUMENTS 1,294,446 A * 2/1919 Greenstreet ..... A63H 33/105 446/122
3,456,413 A * 7/1969 Fischer ..... A63H 33/084 52/591.1
4,698,023 A * 10/1987 Marino ..... G09B 1/36 434/259
5,267,863 A * 12/1993 Simmons, Jr. ..... A63F 9/0613 434/96
5,575,120 A * 11/1996 Handley ..... A47B 87/007 446/124
5,651,753 A * 7/1997 Wilkinson ..... A63B 23/0458 482/52
10,112,070 B2 * 10/2018 Kao ..... A63B 21/4034
2004/0102132 A1 * 5/2004 Miller ..... A63H 33/082 446/125
2007/0167301 A1 * 7/2007 Evans ..... A63B 21/00047 482/148
2008/0004167 A1 * 1/2008 Endelman ..... A63B 21/00047 482/142
2008/0280523 A1 * 11/2008 Bishop ..... A63H 33/082 446/124
2014/0221182 A1 * 8/2014 Lin ..... A63B 21/0004 482/142

(Continued)

*Primary Examiner* — Joshua Lee
*Assistant Examiner* — Catrina A Letterman
(74) *Attorney, Agent, or Firm* — Larry D. Johnson

(57) ABSTRACT

An exercise device that may be used to perform a complete exercise routine. In some implementations, the device includes three block members. A first block may be in the form of a modified rectangular prism. Sides of the first block may have cutouts extending downwardly from the top of the block for receiving a user's feet or elbows for exercises. A portion of the front side of the first block may slope inwardly toward the bottom of the block, and a portion of the top may slope inwardly toward the front side. At the junction of the top and front sides, a rectangular notch may be provided for cradling a user's upper arm or lower leg for exercises. A second block may be in the form of a rectangular prism, and may be joined to the first block for use in some exercises. A third block may be in the form of a truncated triangular prism, and may be positioned between the first block and the ground to tilt and/or stabilize the first block during some exercises. The sides of some of the blocks may incorporate a surface feature to enable the blocks to interlock with each other.

10 Claims, 3 Drawing Sheets

(56) References Cited

U.S. PATENT DOCUMENTS

| | | | | |
|---|---|---|---|---|
| 2015/0258363 | A1* | 9/2015 | Kampinski | A63B 21/4037 482/139 |
| 2016/0346707 | A1* | 12/2016 | Kuo | E04B 2/24 |
| 2017/0291055 | A1* | 10/2017 | Madion | A63B 21/4039 |
| 2018/0117487 | A1* | 5/2018 | Dumphy | A63H 33/086 |
| 2020/0171400 | A1* | 6/2020 | Felix | A63H 33/088 |

* cited by examiner

EXERCISE DEVICE

TECHNICAL FIELD

This written description relates generally to fitness and exercise equipment, and more particularly to an improved exercise device.

SUMMARY

Described below is an exercise device that may be used in a variety of ways to perform a complete exercise routine. In some implementations, the device includes three bodies or block members. A first block may be in the form of a modified rectangular prism having a top, bottom, front, back, right and left sides. The left side of the first block may have a pair of cutouts extending downwardly from the top of the block for receiving a user's feet for some exercises, or a user's elbows for other exercises. The right side of the first block may have a single cutout extending downwardly from the top of the block for receiving a user's foot for some exercises. A portion of the front side of the first block may slope inwardly toward the bottom of the block. A portion of the top of the first block may slope inwardly toward the front side. At the junction of the top and front sides of the first block, a rectangular notch may be provided for cradling a user's upper arm for some exercises, or a user's lower leg for other exercises. A second block may be in the form of a rectangular prism, and may be joined to the first block for use in some exercises, or separated from the first block for use in other exercises. A third block may be in the form of a truncated triangular prism or wedge, and may be positioned between the first block and the ground to tilt and/or stabilize the first block during some exercises. In some implementations, one or more sides of some of the blocks may incorporate a surface feature to enable the blocks to interlock with each other.

Particular embodiments of the subject matter described in this specification can be implemented so as to realize one or more of the following advantages.

In some implementations, one or more of the blocks may be used separately for a variety of exercises.

In some implementations, one or more of the blocks may be arranged together for a variety of exercises.

In some implementations, the device provides an all in one exercise product that serves the function of an entire gym in a compact solution.

In some implementations, the device allows the user to do over 50 different exercises within the comfort of their own home.

In some implementations, the device is easy to use and lightweight.

In some implementations, the device can be easily carried and stored away.

The details of one or more embodiments of the subject matter described in this specification are set forth in the accompanying drawings and the description below. Other features, aspects, and advantages of the subject matter will become apparent from the description, the drawings, and the claims.

Those skilled in the art will appreciate that the conception upon which this disclosure is based readily may be utilized as a basis for the designing of other structures, methods and systems that include one or more of the various features described below.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

DETAILED DESCRIPTION

Figure 1:
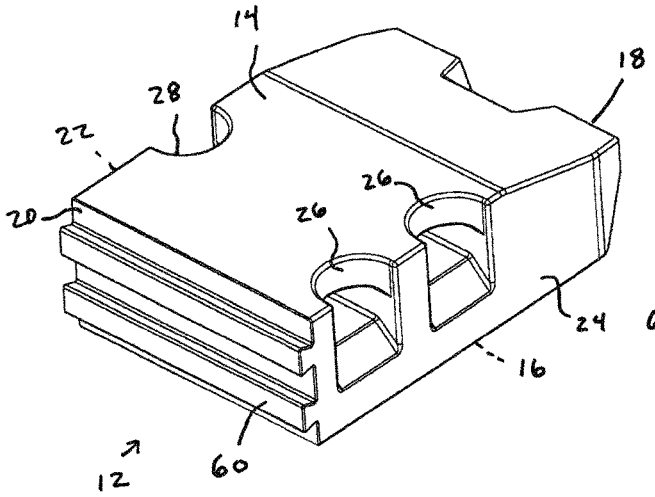
FIG. 1 is an isometric view of one implementation of a first block of an exercise device.

Referring to FIGS. 1 through 10, wherein like reference numerals refer to like components in the various views, there is illustrated therein some implementations of an exercise device.

FIG. 1 is an isometric view of one implementation of a first block 12 of an exercise device. First block 12 may be in the form of a modified rectangular prism (e.g., approximately 8 inches high by 24 inches long by 17 inches wide) having a top 14, bottom 16, front 18, back 20, right side 22, and left side 24. The left side 24 of the first block 12 may have a pair of cutouts such as D-shaped cutouts 26 extending downwardly from the top of the block (e.g., approximately 4.5 inches wide by 4-6 inches deep, with a medial portion extending inwardly into the block approximately 6.75 inches to accommodate a user's feet) for some exercises, or a user's elbows for other exercises. The right side 22 may have a single cutout such as D-shaped cutout 28 extending downwardly from the top of the block (e.g., approximately 4.5 inches wide by 4 inches deep, with a medial portion extending inwardly into the block approximately 6.75 inches to accommodate a user's foot) for some exercises.

Figure 2:
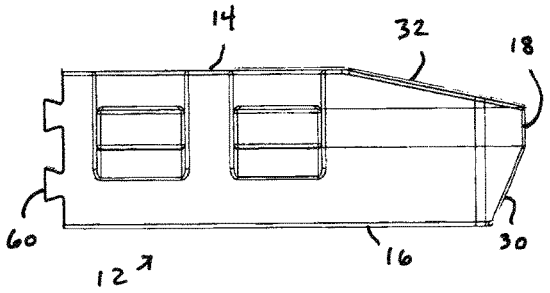
FIG. 2 is a left side view thereof.

FIG. 2 is a left side view of a first block 12. A portion 30 of the front side 18 may slope inwardly toward the bottom 16 of the block (e.g., approximately 24 degrees inward angle). A portion 32 of the top 14 of the block may slope inwardly toward the front side 18 (e.g., approximately 12 degrees inward angle).

Figure 3:
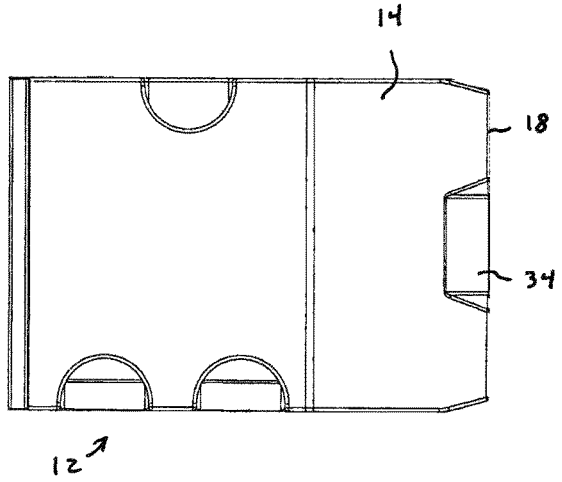
FIG. 3 is a top view thereof.
Figure 4:
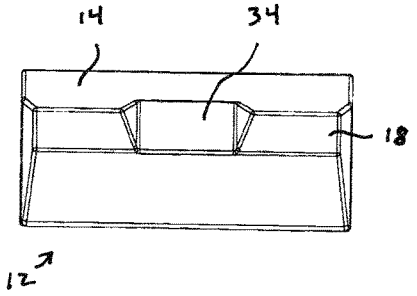
FIG. 4 is a front view thereof.

FIG. 3 is a top view of a first block 12, and FIG. 4 is a front view thereof. At the junction of the top 14 and front side 18, a rectangular notch 34 may be provided for cradling a user's upper arm for some exercises, or a user's lower leg for other exercises.

Figure 5:
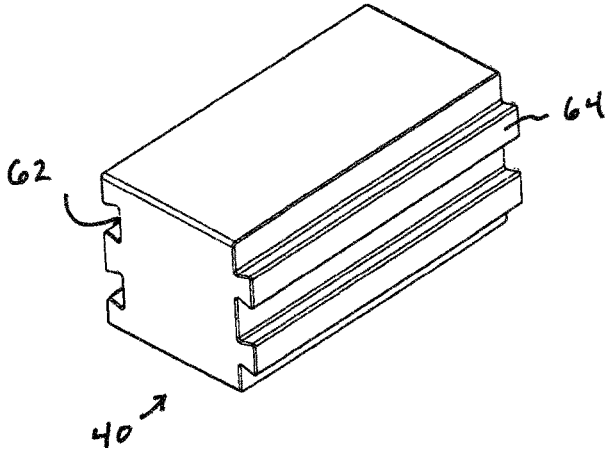
FIG. 5 is an isometric view of one implementation of a second block of an exercise device.

FIG. 5 is an isometric view of one implementation of a second block 40 of an exercise device. Second block 40 may be in the form of a rectangular prism (e.g., approximately 8 inches high by 8 inches long by 17 inches wide), and may be joined to the first block 12 for use in some exercises, or separated from the first block for use in other exercises.

Figure 6:
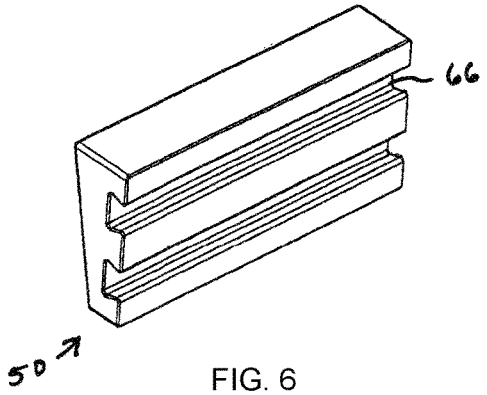
FIG. 6 is an isometric view of one implementation of a third block of an exercise device.

FIG. 6 is an isometric view of one implementation of a third block 50 of an exercise device. Third block 50 may be in the form of a truncated triangular prism or wedge (e.g., approximately 8 inches high by 3.5 inches long by 17 inches wide, with an approximately 79 degree included angle), and may be positioned between the first block 12 and the ground to tilt and/or stabilize the first block during some exercises.

In some implementations, one or more sides of some of the blocks may incorporate a surface feature to enable the blocks to interlock or otherwise be joined with each other. For example, a trapezoidal tongue 60 on the back side of first block 12 (FIGS. 1 and 2) may slidingly engage with a trapezoidal groove 62 on a front side of second block 40 (FIG. 5). Similarly, a trapezoidal tongue 64 on a back side of second block 40 (FIG. 5) may slidingly engage with a trapezoidal groove 66 on a front side of third block 50 (FIG. 6). In some implementations, the back side 20 of the first block 12, two opposite sides of the second block 40, and one side of the third block 50 may include one of a trapezoidal tongue or corresponding trapezoidal groove to enable all three blocks to be joined together.

These tongue and groove positions can be reversed or exchanged on the respective blocks, or other interlock or joining features to join the blocks could be utilized, as is well known in the art.

Figure 7:
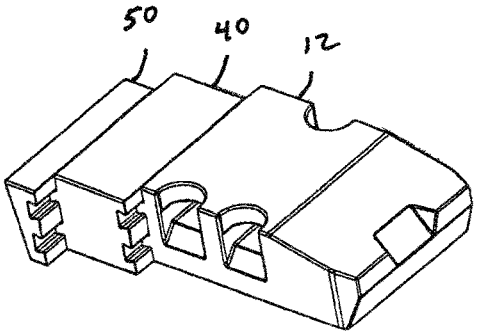
FIG. 7 is an isometric view of a first, second, and third block of an exercise device having been partially interlocked together.
Figure 8:
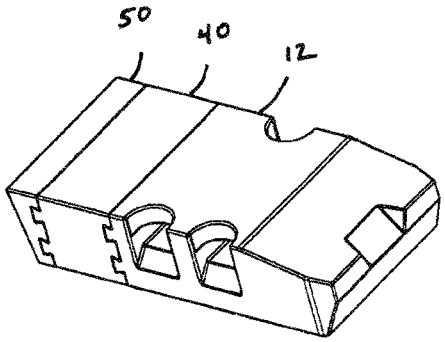
FIG. 8 is an isometric view of a first, second, and third block of an exercise device having been fully interlocked together.

FIG. 7 is an isometric view of a first block 12, second block 40, and third block 50 of an exercise device having been partially interlocked together by the trapezoidal tongues and corresponding trapezoidal grooves surface features described above, while FIG. 8 is an isometric view of a first block 12, second block 40, and third block 50 of an exercise device having been fully interlocked together.

Figure 9:
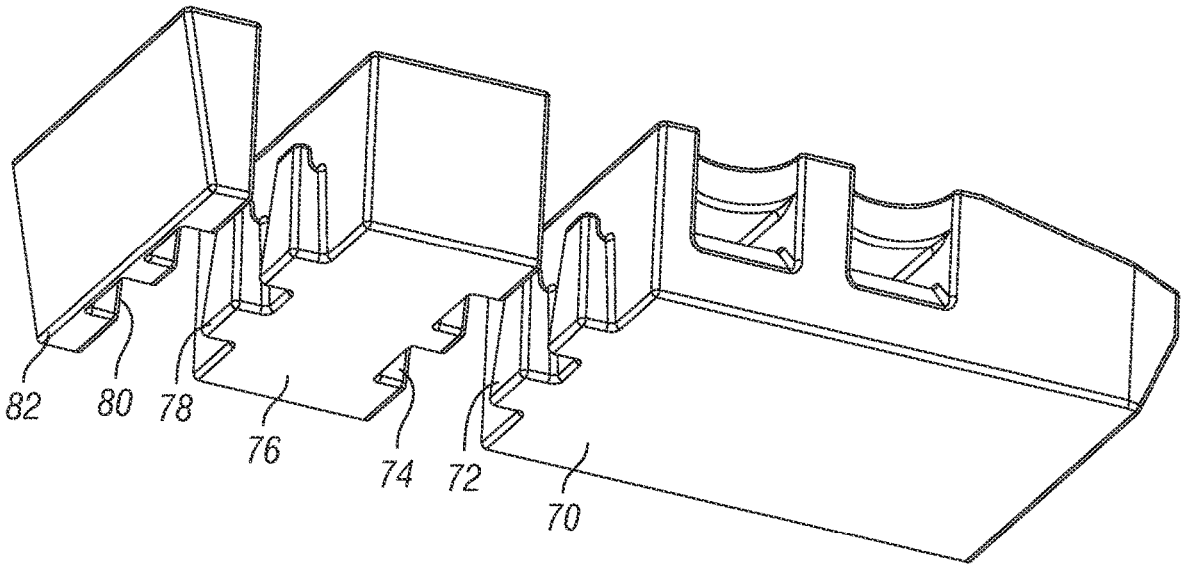
FIG. 9 is an isometric view of another implementation of a first, second, and third block of an exercise device.

FIG. 9 is an isometric view of another implementation of a first, second, and third block of an exercise device, illustrating an alternate surface feature to enable the blocks to interlock or otherwise be joined with each other. First block 70 may include one or more offset posts 72 on a back side thereof, to engage complementary inset sockets 74 on a front surface of second block 76. Similarly, second block 76 may include one or more offset posts 78 on a back side thereof, to engage complementary inset sockets 80 on a front surface of third block 82. In some implementations, the back side of the first block 70, two opposite sides of the second block 76, and one side of the third block 82 may include one or more of an offset post or corresponding inset socket to enable all three blocks to be joined together.

These offset post and inset socket positions can be reversed or exchanged on the respective blocks, or other interlock or joining features to join the blocks could be utilized, as is well known in the art.

In some implementations, the blocks may be used separately or arranged together for a variety of exercises, for example:

Using the first block with the third block underneath will make an incline. Using the blocks this way will allow the user to do the following exercises: incline bench press, incline fly, hyper extension, tricep extension, dumbbell curls, hyperextension, sidekicks for legs, lunges, stretch, decline press, and decline fly.

Using all three blocks with the first block face down, place the small end of the third block under the angle edge of the first block to make a flat surface. Place the second block on the opposite side of the first block to lengthen. Exercises: bench press, dumbbell fly, pullover, nose breakers, and aerobic step.

The blocks may also be used separately or arranged together for a variety of other exercises including but not limited to stretching calves, runners stretch exercise, double standing calf raise exercise, donkey calf raise exercise, seated calf raise exercise, single calf raise exercise, thigh stretch exercise, lunge exercise, aerobic step exercise, side leg raise exercise, single leg squat exercise, hamstring curl with dumbbell exercise, hamstring stretch exercise, hyperextension exercise, stiff leg deadlift/bent over row exercise, donkey kick exercise, bent over row exercise, pullover exercise, bench press exercise, incline bicep curl exercise, dumbbell row exercise, shoulder press, dumbbell side laterals, front laterals, bicep curls exercise, ab stretch/push-ups exercise, decline press exercise, decline fly exercise, e-z curl tricep extension exercise, dips exercise, concentration curl exercise, preacher curl exercise, forearm wrist curl exercise, runners bicep curl exercise, standing preacher curl exercise, lower ab leg raise exercise, sit-up/lower ab exercise, sit-up exercise, and oblique exercise.

The blocks may be constructed from any suitable or appropriate material. In some implementations, the blocks are constructed of polyurethane foam. In some implementations, the blocks are constructed of polyethylene. In some implementations, the blocks are constructed of polypropylene. In some implementations, the blocks are constructed of nylon. In some implementations, the blocks are constructed of inflatable rubber. Other materials may also be used, and the blocks may also be covered, such as by fabric or plastic, for example.

The blocks may be produced by any suitable or appropriate technique. In some implementations, the blocks are produced by roto molding. In some implementations, the blocks are produced by blow molding. In some implementations, the blocks are produced by machining.

In some implementations, the blocks may be contained and carried in a folded mat. In some implementations, the blocks may be part of a core block kit with three blocks, a carrying strap, and a mat.

Figure 10:
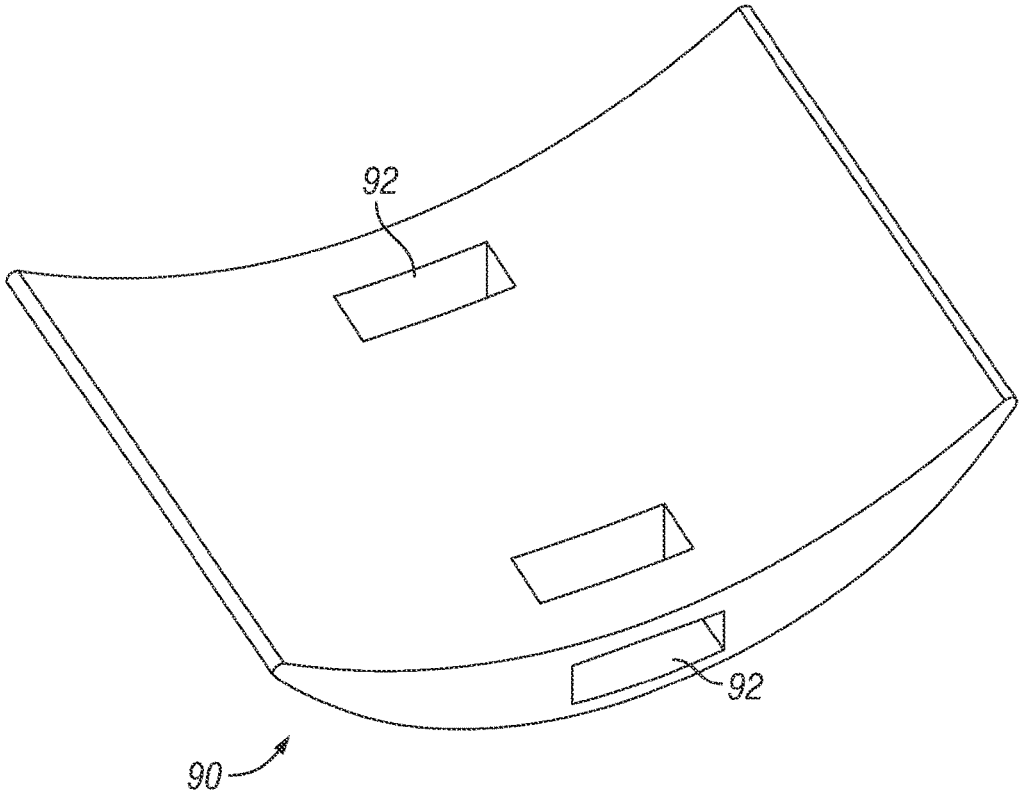
FIG. 10 is a partially cutaway isometric view of one implementation of a separate block used for core and lower back exercises.

FIG. 10 is a partially cutaway isometric view of one implementation of a separate block 90 that may be used for core and lower back exercises. Block 90 may be generally rectangular in plan view and with an arcuate cross section (e.g., approximately 6 inches thick at the center by 28 inches long by 18 inches wide), and may include one or a pair of cavities 92, which may be used as a hand grip when doing leg raises. For a sit-up or crunches the user would sit at the end of the block and rock back and forth. When doing leg raises the user would turn the block over to where the arc part would be face down to the floor, and the user would sit in the center of the block and hold on to the cavity hand grips and lean back and do a leg raise. To stretch the stomach the user could lean back on the arc looking at ceiling and have a nice stretch. Also, with the arc facing down to the floor the user could lay face down with their stomach on the arc and do lower back "hyper extensions."

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An exercise device that may be used in a variety of ways to perform a complete exercise routine, the device comprising:

a first block in the form of a modified rectangular prism having a top, bottom, front, back, right and left sides, wherein one of the right and left sides of the first block has a pair of cutouts extending downwardly from the top of the first block for receiving a user's feet for some exercises, or a user's elbows for other exercises, and the other of the right and left sides of the first block has a single cutout extending downwardly from the top of the first block for receiving a user's foot for some exercises;

a second block in the form of a rectangular prism having sides, wherein the second block is joined to the first block for use in some exercises, and separated from the first block for use in other exercises; and a third block in the form of a truncated triangular prism having sides, wherein the third block is positioned between the first block and the ground to stabilize the first block during some exercises, wherein one or more sides of the first block, the second block, and the third block include a surface feature to enable the blocks to interlock with each other.

2. The exercise device of claim 1 wherein a portion of the front side of the first block slopes inwardly toward the bottom of the first block.

3. The exercise device of claim 2 wherein a portion of the top of the first block slopes inwardly toward the front side of the first block.

4. The exercise device of claim 3 wherein a junction of the top and front sides of the first block includes a notch for cradling a user's upper arm for some exercises, or a user's lower leg for other exercises.

5. The exercise device of claim 1 wherein the surface feature comprises one of a trapezoidal tongue and a trapezoidal groove.

6. The exercise device of claim 1 wherein the surface feature comprises one of an offset post and an inset socket.

7. The exercise device of claim 1 wherein the first block, the second block, and the third block are constructed from one of polyurethane foam, polyethylene, polypropylene, nylon, or inflatable rubber.

8. The exercise device of claim 1 wherein the first block, the second block, and the third block are produced by one of roto molding, blow molding, or machining.

9. The exercise device of claim 1 wherein the back side of the first block, two opposite sides of the second block, and one side of the third block include one of a trapezoidal tongue or corresponding trapezoidal groove to enable all three blocks to be joined together.

10. The exercise device of claim 1 wherein the back side of the first block, two opposite sides of the second block, and one side of the third block include one or more of an offset post or corresponding inset socket to enable all three blocks to be joined together.

* * * * *